US010791389B1

(12) United States Patent
Khaleghimeybodi et al.

(10) Patent No.: US 10,791,389 B1
(45) Date of Patent: Sep. 29, 2020

(54) EAR-PLUG ASSEMBLY FOR ACOUSTIC CONDUCTION SYSTEMS

(71) Applicant: Facebook Technologies, LLC, Menlo Park, CA (US)

(72) Inventors: Morteza Khaleghimeybodi, Bothell, WA (US); Drew Stone Briggs, Seattle, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/424,797

(22) Filed: May 29, 2019

(51) Int. Cl.
*H04R 1/10* (2006.01)
*H04R 3/04* (2006.01)

(52) U.S. Cl.
CPC ..... *H04R 1/1041* (2013.01); *H04R 1/1016* (2013.01); *H04R 1/1091* (2013.01); *H04R 3/04* (2013.01); *H04R 2420/07* (2013.01); *H04R 2460/13* (2013.01)

(58) Field of Classification Search
CPC .. H04R 1/1016; H04R 1/1041; H04R 1/1091; H04R 3/04; H04R 25/50; H04R 25/502; H04R 25/505; H04R 25/604; H04R 25/606; H04R 25/353; H04R 2225/023; H04R 2225/025; H04R 2225/57; H04R 2460/13
USPC .... 381/326, 328, 329, 151, 74, 380; 607/55, 607/56, 57; 600/25
See application file for complete search history.

(56) References Cited

U.S. PATENT DOCUMENTS

| | | | | |
|---|---|---|---|---|
| 6,532,294 | B1 * | 3/2003 | Rudell | A23G 9/503 381/314 |
| 6,643,378 | B2 * | 11/2003 | Schumaier | H04R 25/606 381/318 |
| 7,406,179 | B2 * | 7/2008 | Ryan | H04R 1/10 381/312 |
| 8,005,248 | B1 * | 8/2011 | Davant | H04R 25/305 381/324 |
| 8,005,249 | B2 * | 8/2011 | Wirola | H04R 1/1016 381/190 |
| 8,144,891 | B2 * | 3/2012 | Her | H04R 25/00 381/151 |
| 9,226,082 | B2 * | 12/2015 | Friis | H04R 25/305 |
| 10,356,231 | B2 | 7/2019 | Hosoi et al. | |
| 10,506,343 | B2 * | 12/2019 | Hosoi | H04R 1/02 |
| 2007/0086599 | A1 * | 4/2007 | Wilmink | A61F 11/08 381/74 |
| 2012/0177209 | A1 * | 7/2012 | Goldstein | A61B 5/6817 381/56 |
| 2019/0342647 | A1 * | 11/2019 | Mehra | H04R 1/105 |

* cited by examiner

*Primary Examiner* — Xu Mei
(74) *Attorney, Agent, or Firm* — Fenwick & West LLP

(57) ABSTRACT

An ear-plug assembly is implemented as part of an audio system to present a user with improved audio content. The audio system uses an acoustic conduction system to provide audio content to the user using tissue (e.g., bone and/or cartilage) born acoustic pressure waves. The ear-plug assembly mitigates leakage of low frequency components of airborne acoustic waves generated within the ear canal from the ear. The acoustic conduction system adjusts how content is presented based in part on the presence of the ear-plug assembly within the ear. In some embodiments, the ear-plug assembly may include one or more microphones (external and/or internal), and the acoustic conduction system adjusts how content is presented based on the signals detected by the one or more microphones.

20 Claims, 7 Drawing Sheets

300

500

EAR-PLUG ASSEMBLY FOR ACOUSTIC CONDUCTION SYSTEMS

BACKGROUND

The present disclosure relates generally to an audio system in a headset, and specifically relates to ear plug assemblies for acoustic conduction systems.

Headsets often include features such as audio systems to provide audio content to users of the headsets. The audio content may be provided to the user using bone conduction and/or cartilage conduction technologies. In such conduction technologies, the ear canal of the user can be open (un-occluded), while delivering the audio content. However, in some instances, this may lead to poor sound quality, because the low frequency components of the playback signal tend to leak out of the user's ears. Therefore, the user may not benefit from critical low frequency audio content if the ear canal of the user remains open. Additionally, as the ears are open, external noise from the local area can also compete with audio content being provided by the cartilage conduction technologies. And external noise and/or the leakage of the low frequency components is problematic to the goal of providing an immersive audio experience to the user of the headset.

SUMMARY

An ear-plug assembly is an in-ear device implemented as part of an audio system to present a user with improved audio content. The audio system may use an acoustic conduction system (e.g., bone conduction and/or cartilage conduction) to provide the audio content to the user. The acoustic conduction system includes a transducer assembly that includes one or more bone conduction transducer, one or more cartilage conductions transducer, or some combination thereof. The ear-plug assembly improves a low frequency response of the audio system by at least partially occluding the ear canal and mitigating leakage of low frequency audio components from the ear canal. Furthermore, the ear-plug assembly may have one or more sensors (e.g., internal acoustic sensor assembly, external acoustic sensor assembly, etc.). These sensors may provide feedback and/or feedforward signals to the audio system. The signals may correspond to, e.g., the acoustic pressure waves in the ear canal and/or proximate to and outside an entrance to the ear canal. The signals may be used by the audio system to adjust an audio frequency response of the audio system and/or provide updated vibration instructions to the transducer assembly.

Embodiments are directed to an ear-plug assembly that includes a plug body. At least a portion of the plug body is configured to fit inside a user's ear canal (e.g., to partially or fully occlude the wearer's ear-canal). The plug body inside the ear canal mitigates loss of a portion of the airborne acoustic pressure wave created by bone conduction or cartilage/tragus conduction transducer assembly. The ear-plug assembly may also include a locator assembly within (and/or coupled to) the plug body that provides a signal to an acoustic conduction system. The signal may indicate that the ear-plug assembly is at least partially inside the ear canal. The acoustic conduction system is configured to generate a tissue born acoustic pressure wave that causes an updated airborne acoustic pressure wave inside the ear canal.

Some embodiments are directed to an audio system. The audio system comprises one or more ear plug assemblies and the acoustic conduction system. Each of the one or more ear plug assemblies includes a plug body, a locator assembly, and a sensor. The plug body is configured to at least partially fit inside an ear canal of a user. The plug body mitigates loss of a portion of an airborne acoustic pressure wave within the ear canal. The locator assembly is within and/or coupled to the plug body. The locator assembly emits a signal that identifies that the ear-plug assembly is at least partially inside the ear canal. The acoustic conduction system comprises a transducer assembly and a controller. The transducer assembly is configured to be coupled to a portion of the user's head. For example, the transducer assembly may couple at a mastoid, a condyle, some portion of ear cartilage (e.g., pinna and/or tragus), or some combination thereof. The transducer assembly is configured to generate acoustic pressure waves in accordance with vibration instructions. The controller is configured to provide vibration instructions to the transducer assembly. The controller is configured to adjust a frequency response model based on the received signals, and generate updated vibration instructions using the adjusted frequency response model. The controller provides the updated vibration instructions to the transducer assembly. And the acoustic conduction system is configured to generate a tissue born acoustic pressure wave that causes an updated airborne acoustic pressure wave inside the ear canal.

Some embodiments are directed toward a method for providing audio content. Vibration instructions are provided to a transducer assembly. The transducer assembly provides audio content to a user by vibrating tissue of the user in accordance with the vibration instructions. Signals are received from a sensor coupled to an ear-plug assembly located at least partially inside an ear canal of the user. The signals may indicate, e.g., that the ear-plug assembly is worn by the user, may describe airborne acoustic waves within the ear canal, describe airborne acoustic pressure waves in a local area outside of the ear canal, etc. A frequency response model is updated based on the received signals. Updated vibration instructions are generated using the updated frequency response model. And the updated vibration instructions are provided to the transducer assembly. The transducer assembly provides the audio content such that a frequency response of the ear approximates a target frequency response.

Figure 1:
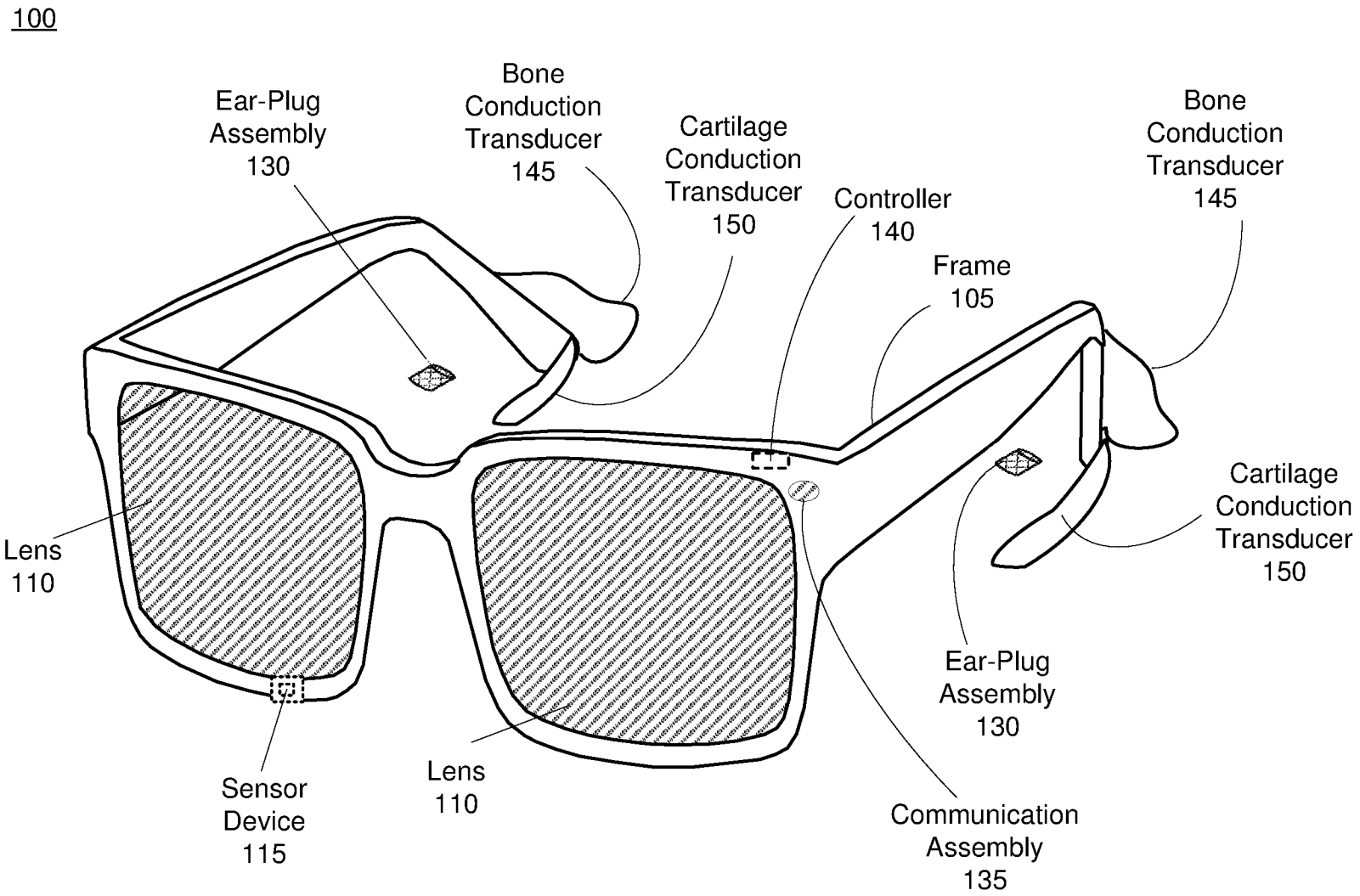
FIG. 1 is a perspective view of a headset, in accordance with one or more embodiments.

The figures depict embodiments of the present disclosure for purposes of illustration only. One skilled in the art will readily recognize from the following description that alternative embodiments of the structures and methods illustrated herein may be employed without departing from the principles, or benefits touted, of the disclosure described herein.

DETAILED DESCRIPTION

Embodiments of the present disclosure may include or be implemented in conjunction with an artificial reality system. Artificial reality is a form of reality that has been adjusted in some manner before presentation to a user, which may include, e.g., a virtual reality, an augmented reality, a mixed reality, a hybrid reality, or some combination and/or derivatives thereof. Artificial reality content may include completely generated content or generated content combined with captured (e.g., real-world) content. The artificial reality content may include video, audio, haptic feedback, or some combination thereof, and any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., perform activities in) an artificial reality. The artificial reality system that provides the artificial reality content may be implemented on various platforms, including a headset, a head-mounted display (HMD) connected to a host computer system, a standalone HMD, a near-eye display (NED), a mobile device or computing system, or any other hardware platform capable of providing artificial reality content to one or more viewers.

An ear-plug assembly that is part of an audio system that provides improved audio content to a user. The ear-plug assembly improves the audio content by improving, e.g., bandwidth, efficiency, audio level, or some combination thereof. The audio system also includes an acoustic conduction system. The acoustic conduction system (e.g., via bone conduction audio system and/or cartilage conduction audio system) provides audio content to the user. The ear-plug assembly may have one or more sensors that provide signals to the acoustic conduction audio system. These sensors may provide feedback and/or feedforward signals to the audio system.

A bone conduction audio system uses bone conduction for providing audio content to the ear of a user while keeping the ear canal of the user unobstructed. The bone conduction audio system includes a transducer assembly that generates tissue born acoustic pressure waves corresponding to the audio content by vibrating tissue in a user's head that includes bone. Tissue may include e.g., bone, cartilage, muscle, skin, etc. For bone conduction, the primary pathway for the generated acoustic pressure waves is through the bone of the head (bypassing the eardrum) directly to the cochlea. The cochlea turns tissue borne acoustic pressure waves into signals which the brain perceives as sound. Note that there may be a secondary effect whereby the tissue borne acoustic pressure waves vibrate the eardrum and/or portions of the ear canal which results in an airborne acoustic pressure wave that originates within the ear canal and travels towards the entrance of the ear canal.

A cartilage conduction audio system uses cartilage conduction for providing audio content to an ear of a user. The cartilage conduction audio system includes a transducer assembly that is coupled to one or more portions of the auricular cartilage around the outer ear (e.g., the pinna, the tragus, some other portion of the auricular cartilage, or some combination thereof). The transducer assembly generates airborne acoustic pressure waves corresponding to the audio content by vibrating the one or more portions of the auricular cartilage. This airborne acoustic pressure wave may the propagate toward an entrance of the ear canal where it would be detected by the ear drum. However, the cartilage conduction audio system is a multipath system that generates acoustic pressure waves in different ways. For example, vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof.

Note that the acoustic conduction system is different from airborne audio systems (e.g., a conventional speaker) for at least the reason that the acoustic conduction system can generate airborne acoustic waves by directly vibrating tissue (bone, cartilage, etc.) of the user. In contrast, a typical airborne audio system uses speakers with vibrating membranes that directly displace air to generate airborne acoustic waves.

Typically, for bone and/or for cartilage conduction systems, the ear canal of the user is open (i.e., un-occluded) while delivering the audio content. However, this may lead to a poor sound quality, because low frequency components of the playback signal tend to leak out of the ear canals of the user. In particular, the user may not benefit from audio content that includes low frequency content (e.g., in a sub-bass range (e.g., 20-60 Hz), a bass range (e.g., 60-250 Hz), a low mid-range (e.g., 250-500 Hz), mid-range (500-2 kHz) or some combination thereof), as audio content within these frequency ranges tend to leak out ear canal into a local area outside the ear. Conventionally, in order to compensate for this loss of the low frequency content, conventional audio systems may generate drive signals that boost the volume of the low frequency components (i.e., drive the bass frequencies harder, thereby increasing power consumption). In contrast, the audio system can use one or more ear plug assemblies to improve the low frequency response of the audio system. An ear-plug assembly worn by a user at least partially occludes the ear canal and mitigates leakage of low frequency content from the ear canal. The ear-plug assembly may have one or more sensors. These sensors may provide signals to the audio system. The signals may describe, for example, acoustic pressure waves within the ear canal and/or proximate to and outside an entrance to the ear canal. The signals may be used by the audio system to, e.g., match (e.g., equalize) sound pressure within the ear canal to some target frequency response and/or provide hear-thru functionality. The signals may also be used to, e.g., generate an antiwave that mitigates certain sounds (e.g., cancel canal resonances and/or external noise), determine a proper fit of the ear-plug assembly within the ear, correct for fit-fit and/or person to person variation, pair an acoustic conduction system with a new ear-plug assembly, give an one-time tuning information to the acoustic conduction system to be used without the ear-plug assembly, determine a proper fit of the transducer assembly on to head, correct for hearing loss and/or damage, or some combination thereof.

FIG. 1 is a perspective view of a headset 100, in accordance with one or more embodiments. In some embodiments, the headset 100 presents media to a user, i.e., a user of the headset 100. Examples of media presented by the headset 100 include one or more images, video, audio, or some combination thereof. The headset 100 may include, among other components, a frame 105, a lens 110, a sensor device 115, and an audio system. The audio system provides audio content to a user of the headset using an acoustic conduction system (e.g., a bone conduction audio system and/or cartilage conduction audio system). In alternative configurations, different and/or additional components may be included in the headset 100. Additionally, functionality described in conjunction with one or more of the components shown in FIG. 1 may be distributed among the components in a different manner than described in conjunction with FIG. 1 in some embodiments.

The headset 100 may correct or enhance the vision of a user, protect the eye of the user, or provide images to the user. The headset 100 may be eyeglasses which correct for defects in the user's eyesight. The headset 100 may be sunglasses which protect the user's eye from the sun. The headset 100 may be safety glasses which protect the user's eye from impact. The headset 100 may be a night vision device or infrared goggles to enhance the user's vision at night. The headset 100 may be a NED or HMD that produces artificial reality content for the user. Alternatively, the headset 100 may not include a lens 110 and may be a frame 105 with an audio system that provides audio (e.g., music, radio, podcasts) to the user.

The frame 105 includes a front part that holds the lens 110 and end pieces to attach to a head of the user. The front part of the frame 105 bridges the top of a nose of the user. The end pieces (e.g., temples) are portions of the frame 105 to which the temples of the user are attached. The length of the end piece may be adjustable (e.g., adjustable temple length) to fit different users. The end piece may also include a portion that curls behind the ear of the user (e.g., temple tip, ear piece).

The lens 110 provides or transmits light to the user of the headset 100. The lens 110 is held by a front part of the frame 105 of the headset 100. The lens 110 may be prescription lens (e.g., single vision, bifocal and trifocal, or progressive) to help correct for defects in the user's eyesight. The prescription lens transmits ambient light to the user of the headset 100. The transmitted ambient light may be altered by the prescription lens to correct for defects in the user's eyesight. The lens 110 may be a polarized lens or a tinted lens to protect the user's eyes from the sun. The lens 110 may be one or more waveguides as part of a waveguide display in which image light is coupled through an end or edge of the waveguide to the eye of the user. The lens 110 may include an electronic display for providing image light and may also include an optics block for magnifying image light from the electronic display. Additional details regarding the lens 110 can be found in the detailed description of FIG. 7.

The sensor device 115 estimates a current position of the headset 100 relative to an initial position of the headset 100. The sensor device 115 may be located on a portion of the frame 105 of the headset 100. The sensor device 115 includes a position sensor and an inertial measurement unit.

The audio system of the headset 100 provides audio content to the user of the headset 100. The audio system includes the acoustic conduction system and one or more ear plug assemblies 130. The acoustic conduction system may be configured as a bone conduction audio system and/or a cartilage conduction audio system. The acoustic conduction system includes a communication assembly 135, a transducer assembly, and a controller 140. Additional details regarding the audio system are discussed below with regard to FIGS. 2-6.

The communication assembly 135 communicates with the ear plug assemblies 130. The communication assembly 135 includes at least one receiver and may additionally include at least one transmitter. The communication assembly 135 is configured to receive signals from the ear plug assemblies 130. In some embodiments, the communication assembly 135 may also provide control instructions (from the controller 140) to the ear plug assemblies 130. Note while a single communication assembly 135 is illustrated in other embodiments there may be a plurality of communication assemblies. Similarly, in other embodiments, some or all of the communication assembly 135 may be on different parts of the headset 100. For example, in some embodiments, at least one receiver (and in some instances at least one transmitter) is located on each temple arm of the headset 100, thereby, reducing distance between a receiver/transmitter and a corresponding ear-plug assembly 130 that is worn by the user.

The transducer assembly generates acoustic pressure waves in accordance with vibration instructions from the controller 140. The transducer assembly directly vibrates tissue (e.g., bone, skin, cartilage, etc.) to generate an acoustic pressure wave. The transducer assembly may include one or more transducers. A transducer may be configured to function as a bone conduction transducer (e.g., bone conduction transducer 145) or a cartilage conduction transducer (e.g., cartilage conduction transducer 150). Each transducer assembly may include one or more transducers to cover different parts of a frequency range. For example, a piezoelectric transducer may be used to cover a first part of a frequency range and a moving coil transducer may be used to cover a second part of a frequency range.

The bone conduction transducers 145 generate acoustic pressure waves by vibrating bone/tissue in the user's head. A bone conduction transducer 145 is coupled to an end piece of the frame 105 and may be configured to be behind the auricle coupled to a portion of the user's skull. The bone conduction transducer 145 receives vibration instructions from the controller 140, and vibrates a portion of the user's skull based on the received instructions. The vibrations from the bone conduction transducer 145 generate a tissue-borne acoustic pressure wave that propagates toward the user's cochlea, bypassing the eardrum. Note that while the illustrated embodiment includes two bone conduction transducers 145, in other embodiments there may be more or less bone conduction transducers (e.g., 2 or more for each ear).

The cartilage conduction transducers 150 generate acoustic pressure waves by vibrating one or more portions of the auricular cartilage of the ears of the user. A cartilage conduction transducer 150 is coupled to a temple arm of the frame 105 and may be configured to be coupled to one or more portions of the auricular cartilage of the ear. For example, the cartilage conduction transducer 150 may couple to the back of an auricle of the ear of the user. The cartilage conduction transducer 150 may be located anywhere along the auricular cartilage around the outer ear (e.g., the pinna, the tragus, some other portion of the auricular cartilage, or some combination thereof). Vibrating the one or more portions of auricular cartilage may generate: airborne acoustic pressure waves outside the ear canal; tissue born acoustic pressure waves that cause some portions of the ear canal to vibrate thereby generating an airborne acoustic pressure wave within the ear canal; or some combination thereof. The generated airborne acoustic pressure waves propagate down the ear canal toward the ear drum.

As noted above, for bone and/or for cartilage conduction systems, the ear canal of the user is open (i.e., un-occluded) while delivering the audio content. However, this may lead to a poor sound quality, because low frequency components of the playback signal tend to leak out of the ear canals of the user. In the case of the bone conduction transducer 145, while it primarily generates a tissue borne acoustic pressure wave, there may be a secondary effect whereby the generated tissue borne acoustic pressure wave vibrates the eardrum and/or portions of the ear canal which results in an airborne acoustic pressure wave that originates within the ear canal. Likewise, the cartilage conduction transducer 150 can generate a tissue born acoustic pressure wave that causes some portions of the ear canal to vibrate thereby generating an airborne acoustic pressure wave within the ear canal.

The ear plug assemblies 130 improves the audio content as perceived by the user of the headset 100 when inserted into respective ears of the user. The ear-plug assemblies 130 may improve the audio content by improving, e.g., bandwidth, efficiency, audio level, or some combination thereof. In particular, for a given ear, an ear-plug assembly 130 improves low frequency content by at least partially occluding the ear canal, and thereby mitigating leakage of the low frequency content that would otherwise occur via airborne acoustic pressure waves which are generated within an open and un-occluded ear canal. While FIG. 1 illustrates an ear-plug assembly 130 for each ear, in other embodiments there may be just a single ear-plug assembly 130 for one ear and no ear-plug assembly 130 for the other ear. Additional details regarding various embodiments of the ear plug assemblies 130 can be found below with regard to FIGS. 3-6.

The controller 140 controls the acoustic conduction system. The controller 140 may receive audio data (e.g., music) from local memory or some external entity (e.g., a console, remote server, etc.) for presentation to a user. The controller 140 generates vibration instructions based on the received audio data, and provides the vibration instructions to the transducer assembly. The controller 140 generates and/or updates vibrations instructions based on the audio data and whether or not the ear plug assemblies 130 are worn by the user. For example, if the ear plug assemblies 130 are worn (e.g., placed in the respective ear canals of the user), the controller 140 may apply a corrective filter to the audio data to generate the vibration instructions. As discussed in detail below with regard to FIG. 5, the corrective filter is such that audio content provided by the transducer assembly would have a frequency response that approximates a target frequency response of the ear. For example, the application of the corrective filter may cause the transducer assembly to lower the amplitude associated with low frequency components of the audio content as ear plug assemblies are mitigating loss of the low frequency components (due to their presence in the ear canals). Note that this also provide a power saving advantage as the transducer assembly does not have to work as hard to generate the low frequency content—and the ear-plug assembly could be passive.

In some embodiments, the ear-plug assemblies 130 include an inner microphone. The controller 140 may use signals captured by the inner microphones to dynamically adjust the corrective filter such that audio content provided by the transducer assembly would more closely approximate the target frequency response. For example, the controller 140 may dynamically adjust the corrective filter such that some frequency range (e.g., all audible frequencies) the detected acoustic pressure within the ear canal is within some threshold value of the target frequency response. Signals from the inner microphone may also be used to determine whether an ear-plug assembly 130 is being worn by the user.

In embodiments where the ear plug assemblies 130 include an external microphone, the controller 130 may use sounds captured by the external microphones to generate vibration instructions. And the generated vibration instructions cause the transducer assembly to re-transmit the captured sounds using the transducer assembly, thereby providing a hear-thru functionality.

In some embodiments, the controller 140 may also control operation of one or both of the ear plug assemblies 130. The controller 140 may generate control instructions, which are provided to one or more ear plug assemblies 130 via the communication assembly. Control instructions control operation of one or more components of an ear-plug assembly 130. Control instructions may control whether components of the ear-plug assembly are active or inactive, control microphone characteristics (e.g., gain), etc. For example, the controller 140 may detect that power levels of the ear plug assemblies 130 are low, and generate control instructions that cause some of all of the components the ear plug assemblies 130 to go into an inactive mode (e.g., powered down).

In FIG. 1, the controller 140 is embedded into the frame 105 of the headset 100. In other embodiments, the controller 140 may be located in a different location on the headset 100, be located external to the headset 100, or some combination thereof. Additional details regarding the controller 140 are described below with regard to FIG. 5.

Figure 2:
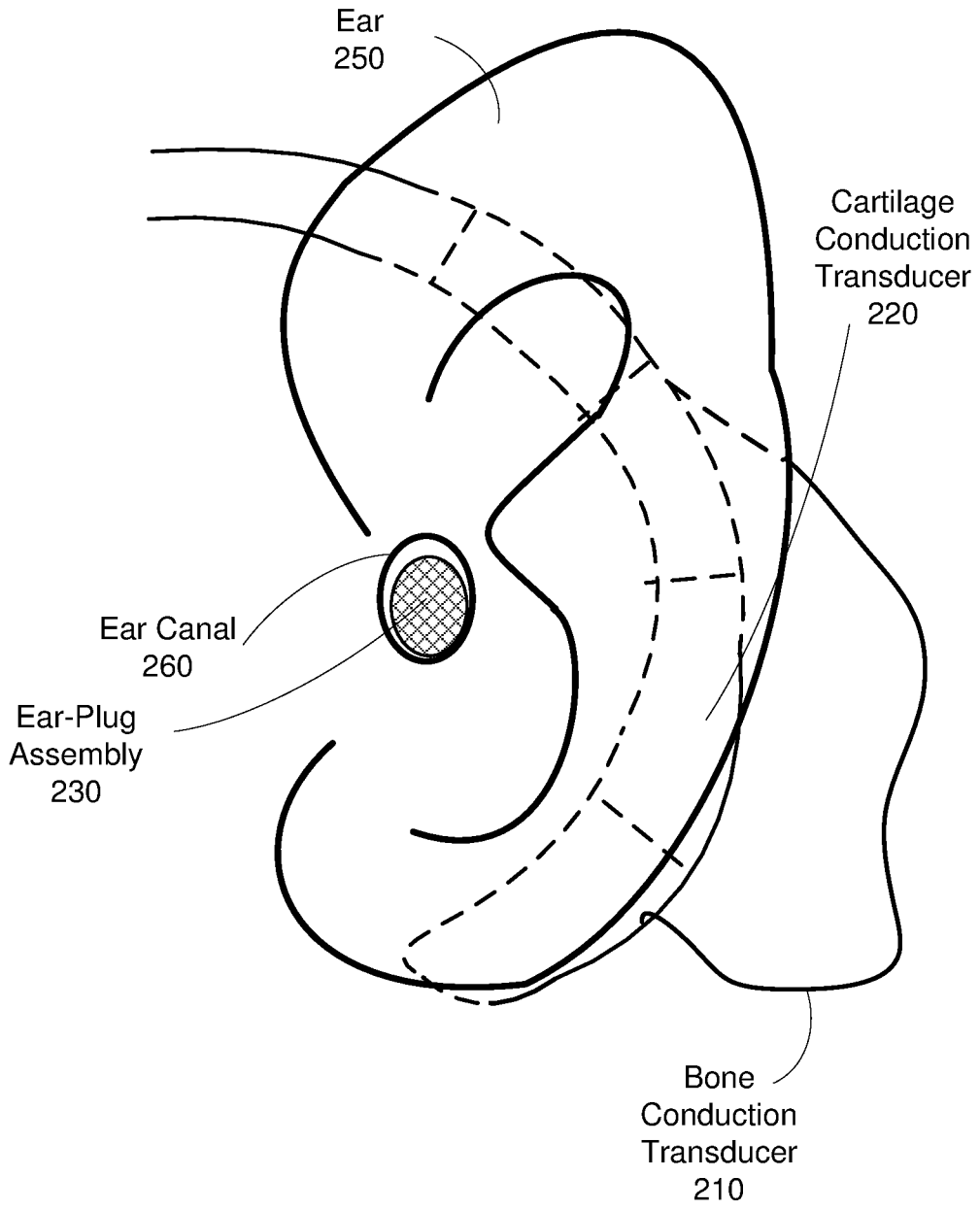
FIG. 2 is a profile view of a portion of the audio system as a component of a headset, in accordance with one or more embodiments.

FIG. 2 is a profile view 200 of a portion of an audio system as a component of a headset (e.g., the headset 100), in accordance with one or more embodiments. In the view 200, the audio system includes, among other components, at least one bone conduction transducer 210, at least one a cartilage conduction transducer 220, and an ear-plug assembly 230. Although FIG. 2 illustrates an embodiment for a left ear 250, in other embodiments, it may also and/or alternatively be for a right ear. Moreover, while FIG. 2 illustrates a single bone conduction transducer 210 and a single cartilage conduction transducer 220, in other embodiments, there may be one or more bone conduction transducers and no cartilage conduction transducers or one or more cartilage conduction transducers and no bone conduction transducers.

The bone conduction transducer 210 generates acoustic pressure waves by vibrating tissue (e.g., bone is primary conduction pathway) in the user's head in accordance with received vibration instructions. It may be coupled to a portion of the user's bone behind the user's ear 250. Alternatively, the bone conduction transducer 210 may be placed at a condyle, i.e., in front of the user's ear 250. The bone conduction transducer 210 may vibrate over a plurality of frequencies. The bone conduction transducer 210 vibrates the portion of the bone to which it is coupled. The portion of the bone conducts the vibrations to generate tissue borne acoustic pressure waves at the cochlea which is then perceived by the user as sound. Furthermore, as previously noted with respect to FIG. 1, the generated tissue borne acoustic pressure waves may vibrate the eardrum which results in a secondary airborne acoustic pressure waves that originate at the eardrum and travel along the ear canal outwards towards the outer ear.

The cartilage conduction transducer 220 generates airborne acoustic pressure waves by vibrating the cartilage in the ear of the user in accordance with received vibration instructions. The cartilage conduction transducer 220 may be coupled to a back of an ear of a user, i.e., to the back of a pinna. In some embodiments (not shown), in addition or in alternative to the cartilage conduction transducer 220, a cartilage conduction transducer may be placed on the tragus. The vibration of the pinna generates the airborne acoustic pressure waves that travel from the outside of the ear, through the ear canal of the user towards the eardrum. Moreover, the cartilage conduction transducer 220 generates tissue born acoustic pressure waves that cause some portions of the ear canal to vibrate thereby generating an airborne acoustic pressure wave within the ear canal.

The ear-plug assembly 230 improves low frequency quality of audio content rendered using the cartilage conduction transducer 220 and/or the bone conduction transducer 210. The ear-plug assembly 230 is located within an ear canal 260 of the user so that it at least partially occludes the ear canal 260. The at least partial occlusion of the ear canal mitigates loss of low frequency components of the airborne acoustic pressure waves (that are generated by the cartilage conduction transducer 220) or of the secondary airborne acoustic pressure waves (that are generated by the bone conduction transducer 210) in the ear canal. In some embodiments, the ear-plug assembly 230 may also improve the audio content by improving, e.g., efficiency, audio level, or some combination thereof.

In some embodiments, the ear-plug assembly 230 may be inactive, serving to mitigate the leakage of low-frequency components of the airborne acoustic pressure waves. An inactive ear-plug assembly 230 may include a locator unit, or may also include one or more active components that are in an inactive mode (e.g., turned off). An active component may be, e.g., an external microphone, an internal microphone, a power and data unit, some other component that uses power, or some combination thereof. In some embodiments, the ear-plug assembly 230 may be active. An active ear-plug assembly 230 includes one or more active components and at least one component is active (e.g., using power from a source within the ear-plug assembly 230). Signals from one or more of the active components may be used by a controller of the audio system to adjust the vibration instructions provided to the cartilage conduction transducer 220 and/or the bone conduction transducer 210. Control instructions received from the acoustic conduction system may determine which components of the ear-plug assembly 230 are active or inactive. Additional details regarding the ear-plug assembly 240 are described below with regard to FIGS. 3 and 5.

Figure 3:
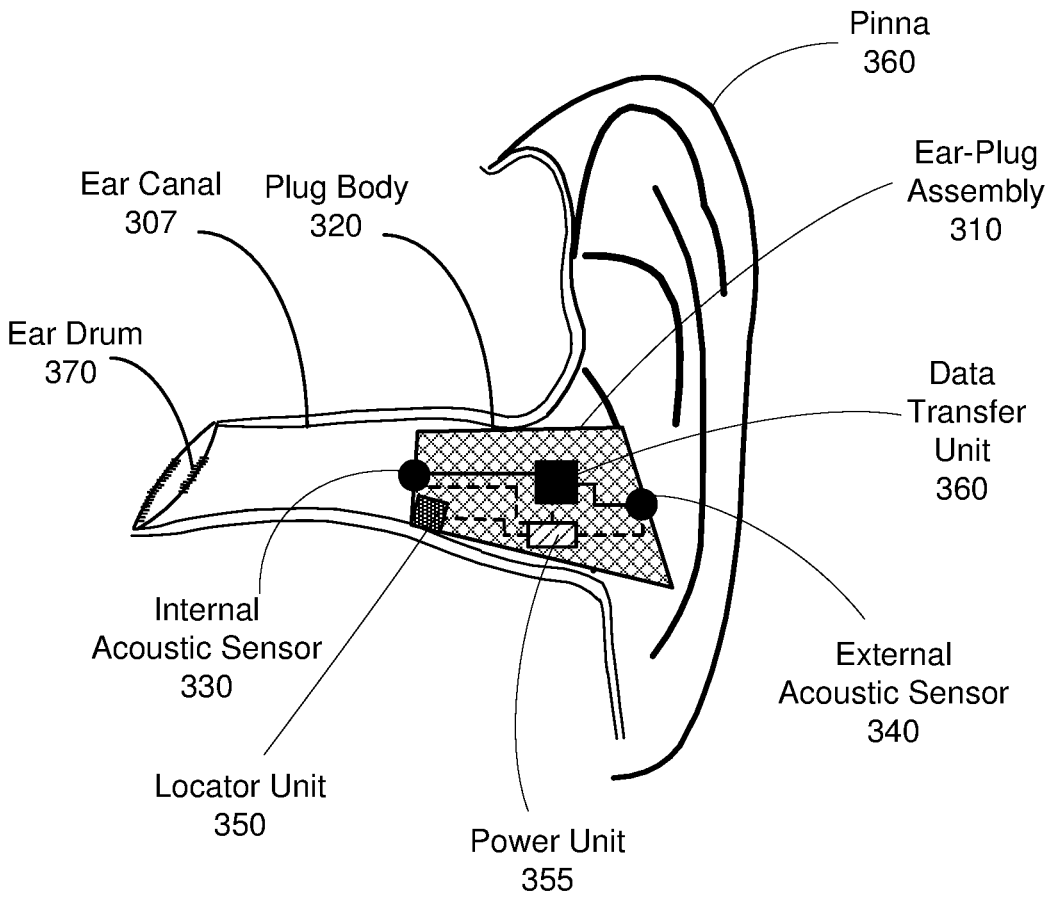
FIG. 3 is a cross sectional view of an ear-plug assembly, in accordance with one or more embodiments.

FIG. 3 is a cross sectional view 300 of an ear-plug assembly 310, in accordance with one or more embodiments. Note that the ear-plug assembly 310 depicted herein is for the left ear of the user. However, a similar ear-plug assembly may be used for the right ear of the user as well.

The ear-plug assembly 310 is used to provide the user with improved audio content. It is placed within an ear canal 307 of the user, as shown in FIG. 3. While FIG. 3 depicts a placement that occludes all of the ear canal 307, in various embodiments, the ear-plug assembly 310 may either partially or fully occlude the ear canal 307. Its placement in the ear canal 307 mitigates loss that occurs through leakage of the low frequencies of the audio content. In some instances, the ear-plug assembly 310 partially occludes the ear canal 307, some leakage of the low frequencies may still occur through any un-occluded portions of the ear canal. When the ear plug fully occludes the ear canal, it may significantly mitigate loss of the low frequencies. Furthermore, it may be used for tuning the audio content provided to the user. The ear-plug assembly 310 may include, among other components, a plug body 320, an internal acoustic sensor 330, an external acoustic sensor 340, a locator unit 350, and a power unit 355, and a data transfer unit 360. In alternative configurations, different and/or additional components may be included in the ear-plug assembly 310. Additionally, in some embodiments, the functionality described in conjunction with one or more of the components shown in FIG. 3 may be distributed among the components in a different manner than described in conjunction with FIG. 3.

The plug body 320 holds the ear-plug assembly 310 in the ear canal 307. It is placed within the ear canal of the user such that its placement occludes at least a portion of the ear canal 307 either entirely, as depicted in FIG. 3, or partially. The plug body 320 contains other components of the ear-plug assembly 310. In the illustrated example, the plug body 320 contains the internal acoustic sensor 330, the external acoustic sensor 340, the locator unit 350, the power unit 355, and the data transfer unit 360. The plug body 320 is formed from one or materials that attenuate sound. The plug body 320 may be composed of, e.g., foam, silicon, plastic, rubber, some other material that attenuates sound, or some combination thereof. In some embodiments, the plug body 320 may have an outer portion or sleeve that deforms to snuggly fit the ear-plug assembly 310 within the ear canal 307. The plug body 320 includes an internal side and an external side. The internal side (faces an ear drum 370) of the plug body 320 is closer to the ear drum 370 than the external side of the plug body 320 (faces towards the local area outside of the ear).

The internal acoustic sensor 330 detects airborne acoustic pressure waves in the ear canal 307. The internal acoustic sensor 330 may be a microphone (e.g., a microelectromechanical system(MEMS) microphone, a capacitive microphone, etc.). A bandwidth of the internal acoustic sensor 330 may be, e.g., 20 Hz to 16 kHz. The internal acoustic sensor 330 may be located within the plug body 320 on and/or near the internal side of the plug body 320 and is positioned to detect airborne acoustic pressure waves between the ear drum 370 and the internal side of the ear plug body 320. In some embodiments, the internal acoustic sensor 330 faces towards the ear drum 370. The airborne acoustic pressure waves detected by the internal acoustic sensor 330 are converted into electrical signals and then provided to the data transfer unit 360.

The external acoustic sensor 340 is configured to detect airborne acoustic pressure waves that are external to the ear canal 307. The external acoustic sensor 340 may be located within the plug body 320 on and/or near the external side of the plug body 320. In some embodiments, the external acoustic sensor 340 faces toward the local area (i.e., away from the ear drum 370). The airborne acoustic pressure waves detected by the external acoustic sensor 340 are converted into electrical signals and then provided to the data transfer unit 360. The detected airborne acoustic pressure waves may be produced via a transducer assembly of the acoustic conduction system, sounds from sound sources in the local area (e.g., a person talking), or some combination thereof.

Note that the external acoustic sensor 340 may be positioned very close to an entrance of the ear-canal 307. The entrance of the ear canal is the least intrusive point where all spatial cues can be captured. Placement of the external acoustic sensor 340 in this location, facilitates capture of binaural audio content. Additionally, the captured content may also be used to calibrate the audio system precisely for presentation of spatialized audio content. Spatialized audio content is audio content that is presented in a manner such that it appears to originate from one or more points in an environment surrounding the user (e.g., from a virtual object in a local area of the user).

The locator unit 350 is used to identify to the acoustic conduction system that the ear-plug assembly 310 is within the ear canal 307. The locator unit 350 may include a radio frequency identification tag that emits a signal in response to a scanning signal from the acoustic conduction system. In some embodiments, the locator unit 350 may comprise a pressure or vibration sensor that senses entry and placement into the ear canal 307, and may subsequently begin transmitting periodic or occasional beacons to the acoustic conduction system. In some embodiments, the locator unit 350 uses signals from the internal acoustic sensor 330 to determine whether the ear-plug assembly 310 is located within the ear canal 307. And in some embodiments, the locator unit 350 is the internal acoustic sensor 330, and the acoustic conduction system uses the detected airborne acoustic pressure waves between the ear drum 370 and the internal side of the ear plug body 320 to determine whether the ear-plug assembly 310 is located within the ear canal 307. In some embodiments, signals (referred to as locator signals) from the locator unit 350 may be used to determine e.g., whether the ear-plug assembly 310 is worn by the user, an amount of seal (i.e., home much the ear-plug body 320 occludes the ear canal 307), a quality of seal (i.e., how much sound is blocked by the ear-plug assembly 310), or some combination thereof.

The power unit 355 provides power to one or more components (e.g., the internal acoustic sensor 330, the external microphone 230, the locator unit 350, the data transfer unit 360, or some combination thereof) of the ear-plug assembly 310. The power unit 355 is a battery embedded within the plug body 320. In some cases, the power unit 355 is a rechargeable battery embedded within the plug body 320. In some embodiments, the power unit 355 may be powered wirelessly (for example, inductively) with the headset (such as the headset 100 depicted in FIG. 1). In these embodiments, the assembly 310 may include a receiving coil to receive the power. In some embodiments, there is more than one power unit 355. And in some instances, one or more components of the ear-plug assembly 310 may have their own dedicated power unit 355.

The data transfer unit 350 transmits signals from the ear-plug assembly 310 to the acoustic conduction system. The signals may include, e.g., signals corresponding to airborne acoustic waves detected by the internal acoustic sensor 330, signals corresponding to airborne acoustic waves detected by the external acoustic sensor 340, signals from the locator unit 230, signals from the power unit 355 (e.g., battery charge level), or some combination thereof.

Figure 4:
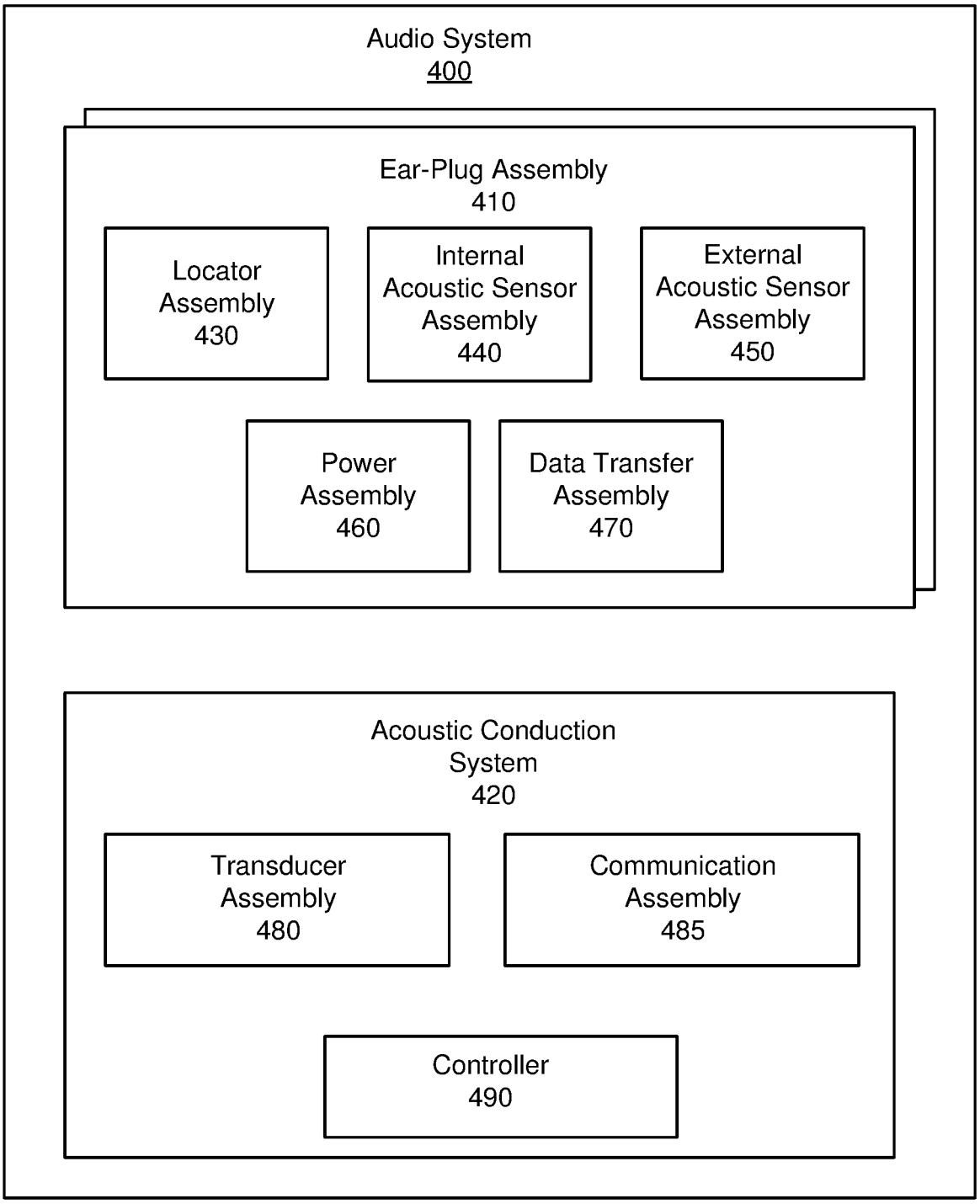
FIG. 4 is a block diagram of an audio system, in accordance with one or more embodiments.

FIG. 4 is a block diagram of an audio system 400, in accordance with an embodiment. The audio system 400 includes one or more ear plug assemblies 410 (e.g., one for each ear), and an acoustic conduction system 420. The audio systems described with reference to FIGS. 1 and 2 are embodiments of the audio system 400. In alternative configurations, different and/or additional components may be included in the audio system 400. Additionally, functionality described in conjunction with one or more of the components shown in FIG. 4 may be distributed in some embodiments among the components in a different manner than described in conjunction with FIG. 4.

The ear-plug assembly 410 improves the frequency response of the audio system 500. The ear-plug assembly 410 is configured to be placed at least partially within an ear canal of a user such that it may partially (and in some cases fully) occlude a portion of the ear canal. Placement of the ear-plug assembly 410 in the ear canal of the user reduces leakage of low frequency acoustic pressure waves into a local area surrounding the ear. The ear-plug assembly 410 includes one or more sensors. The one or more sensors may include at least a locator assembly 430, and in some embodiments, may also include an internal acoustic sensor assembly 440, an external acoustic sensor assembly 450, a power assembly 460, a data transfer assembly 470, or some combination thereof. Note that in some embodiments, the locator assembly 430 is simply the internal acoustic sensor assembly 440. For example, in some embodiments, the ear-plug assembly 410 only includes the locator assembly 430. In contrast, in some embodiments, the ear-plug assembly 410 includes all of the locator assembly 430, the internal acoustic sensor assembly 440, the external acoustic sensor assembly 450, the power assembly 460, and the data transfer assembly 470. In alternative configurations, different and/or additional components may be included in the ear-plug assembly 410. Additionally, functionality described in conjunction with one or more of the components shown in FIG. 4 may be distributed in some embodiments among the components in a different manner than described in conjunction with FIG. 4. The ear-plug assemblies 130, 230, and 310 are all embodiments of the ear-plug assembly 410. In some embodiments, the ear-plug assembly 410 is controlled via control instructions received from the acoustic conduction system 420. Control instructions control operation (e.g., gain, whether a component is active or inactive, etc.) of one or more components of an ear-plug assembly 410.

The locator assembly 430 is configured to identify to the acoustic conduction system 420 that the ear-plug assembly 410 is within the ear canal. The locator assembly 430 includes one or more locator units (e.g., the locator unit 350). The locator unit may be an internal acoustic sensor (e.g., of the external acoustic sensor assembly 450), an RFID tag, a beacon, or some other device that can provide a locator signal to the acoustic conduction system 420 that identifies that the ear-plug assembly 410 is within the ear canal. For example, a local scanner may be part of the acoustic conduction system and/or located on the headset. And the scanner may scan the RFID tag to receive the locator signal. In some embodiments, the locator unit include a sensor (e.g., pressure, contact sensor, etc.) that senses entry and placement into the ear canal. And responsive the sensor sensing placement within the ear canal, the locator unit sends the locator signal to the acoustic conduction system 420 and/or instruct the data transfer assembly 470 to transmit the locator signal. In some embodiments, the locator assembly 430 is or includes the internal acoustic sensor assembly 440. In these embodiments, the locator signal is the detected airborne acoustic pressure waves between the ear drum and an internal side of an ear plug body of the ear-plug assembly 410.

The internal acoustic sensor assembly 440 detects airborne acoustic pressure waves in the ear canal. The internal acoustic sensor assembly 440 includes one or more internal acoustic sensors (e.g., the internal acoustic sensor 330). An internal acoustic sensor is positioned to detect airborne acoustic pressure waves between the ear drum and an internal side of the ear-plug assembly 410. In embodiments described herein, an internal acoustic sensor may be, e.g., a microphone, a vibration sensor, a piezoelectric accelerometer, a capacitive accelerometer, MEMS microphone, a capacitive microphone, some other microphone. A bandwidth of the internal acoustic sensor 330 may be, e.g., 20 Hz to 16 kHz. The airborne acoustic pressure waves detected by the internal acoustic sensor assembly 440 are converted into electrical signals and provided to the data transfer assembly 470. Note, in some embodiments, the airborne acoustic waves are weak, accordingly, in some embodiments, internal acoustic sensor assembly 440 may include one or more amplifiers that amplify the electrical signals.

The external acoustic sensor assembly 450 is configured to detect airborne acoustic pressure waves that are external to the ear canal. The external acoustic sensor assembly 450 includes one or more external acoustic sensors (e.g., the external acoustic sensor 340). An external acoustic sensor is substantially the same as an internal acoustic sensor, except that the external acoustic sensor is positioned to detect airborne acoustic waves from the local area outside of the ear canal. The detected airborne acoustic pressure waves may be produced via a transducer assembly of the acoustic conduction system 420 (i.e., via one or more cartilage conduction transducers), sounds from sound sources in the local area (e.g., a person talking), or some combination thereof. The airborne acoustic pressure waves detected by the external acoustic sensor 340 are converted into electrical signals and then provided to the data transfer assembly 470.

Note that an external acoustic sensor may be positioned very close to an entrance of the ear-canal. The entrance of the ear canal is the least intrusive point where all spatial cues can be captured. Placement of the external acoustic sensor in this location, facilitates capture of binaural audio content. Additionally, the captured content may also be used to calibrate the audio system 400 precisely for presentation of spatialized audio content.

The power assembly 460 provides power to one or more components of the ear-plug assembly 410. The power assembly 460 includes one or more power units (e.g., the power unit 355). The power assembly 460 may provide power to, e.g., the locator assembly 430, the internal acoustic sensor assembly 440, the external acoustic sensor assembly 450, and the data transfer assembly 470, or some combination thereof. In some embodiments, there are one or more power units for some or all of the components of the ear-plug assembly 410. A power unit is a battery. In some cases, a power unit is a rechargeable battery. In some embodiments, the power unit may be powered wirelessly (for example, inductively) with the headset (such as the headset 100 depicted in FIG. 1). In these embodiments, the power assembly 460 may include one or more receiving coils to receive power.

The data transfer assembly 470 transmits signals from the ear-plug assembly 410 to the acoustic conduction system 420. The data transfer assembly 470 includes one or more data transfer units (e.g., the data transfer unit 360). A data transfer unit wirelessly transmits signals to the acoustic conduction system 420. A data transfer unit may transmit the signals via Radio Frequency (RF), BLUETOOTH, WIFI, some other communication methodology, or some combination thereof. The signals may include, e.g., signals corresponding to airborne acoustic waves detected by the internal acoustic sensor assembly 440, signals corresponding to airborne acoustic waves detected by the external acoustic sensor assembly 450, locator signals from the locator assembly 430, signals from the power assembly 460 (e.g., battery charge level), or some combination thereof. Note, in some embodiments, the data transfer assembly 470 includes one or more amplifiers that amplify signals receives from one or more of the components prior to transmitting them as signals to the acoustic conduction system 420.

There are at least two modes of operation for the ear-plug assembly 410. The two modes of operation are an inactive mode and an active mode. In some embodiments, the mode of operation may be set by the user manually on the ear-plug assembly 410. In some embodiments, the mode of operation is set via control instructions from the acoustic conduction system 420. In the inactive mode, the ear-plug assembly 410 operates as a passive ear plug, and does not provide power to at least the internal acoustic sensor assembly 440, the external acoustic sensor assembly 450. In the inactive mode the ear-plug assembly 410 improves the low frequency response of acoustic conduction system by mitigating leakage of low frequency elements of the airborne acoustic pressure waves from the ear canal out into the surrounding atmosphere through an un-occluded ear canal. In particular, the ear-plug assembly 310 mitigates leakage of sub-bass frequencies (20-60 Hz), bass frequencies (60-250 Hz), low mid-range frequencies (250-500 Hz), and mid-range (500-2000 Hz) in the generated audio signals.

In some embodiments, if the ear-plug assembly 410 is not worn, the audio system may compensate for the loss of the low frequency components by generating drive signals to boost the volume of the low frequency components, resulting in greater power consumption by the audio system. Therefore, use of the ear-plug assembly 410 may result in reduced power consumption by the acoustic conduction system. This is because the transducer assembly of the acoustic conduction system does not consume extra power driving the low frequency components harder to compensate for the leakage.

The ear-plug assembly 410 in the active mode improves the low frequency response of acoustic conduction system like it does in the inactive mode. However, in the active mode the ear-plug assembly 410 provides power (e.g., via the power assembly 460) to one or more of its components. For example, in the active mode the internal acoustic sensor assembly 440, the external acoustic sensor assembly 450, the locator assembly 430, the data transfer assembly 470, or some combination thereof, may be active and receiving power from the power assembly 460. In the active mode, the ear-plug assembly 410 provides signals to the acoustic conduction system 420.

The acoustic conduction system 410 provides audio content to the user. In some embodiments, the acoustic conduction system 420 include a transducer assembly 480, a communication assembly 485, and a controller 490. The acoustic conduction system 420 is configured to be part of a headset like, e.g., the acoustic conduction system described in FIG. 1 is part of the headset 100.

The transducer assembly 480 generates acoustic pressure waves based on vibration instructions received from the controller 490. The vibration instructions are based on audio content to be provided to the user. The transducer assembly 480 directly vibrates tissue (e.g., bone, skin, cartilage, etc.) to generate an acoustic pressure wave. The transducer assembly may include one or more transducers.

A transducer provides audio content by directly vibrating tissue to generate an acoustic pressure wave. The transducer may be coupled to a material (e.g., silicone) that attaches well to the portion of the ear and/or skull of the user. A transducer may be, e.g., a piezoelectric transducer, a moving coil transducer, or some other transducer that directly vibrates the tissue of a user to generate an acoustic pressure wave. The piezoelectric transducer may be a stacked piezoelectric actuator. The stacked piezoelectric actuator includes multiple piezoelectric elements that are stacked (e.g. mechanically connected in series). The stacked piezoelectric actuator may have a lower range of voltages because the movement of a stacked piezoelectric actuator can be a product of the movement of a single piezoelectric element with the number of elements in the stack. A piezoelectric transducer is made of a piezoelectric material that can generate a strain (e.g., deformation in the material) in the presence of an electric field. The piezoelectric material may be a polymer (e.g., polyvinyl chloride (PVC), polyvinylidene fluoride (PVDF)), a polymer-based composite, ceramic, or crystal (e.g., quartz (silicon dioxide or $SiO_2$), lead zirconate-titanate (PZT)). By applying an electric field or a voltage across a polymer which is a polarized material, the polymer changes in polarization and may compress or expand depending on the polarity and magnitude of the applied electric field.

A transducer may be configured to function as a bone conduction transducer (e.g., the bone conduction transducer 145) or a cartilage conduction transducer (e.g., the cartilage conduction transducer 150). The transducer assembly may include one or more bone transducers for each ear, one or more cartilage conduction transducers for each ear, or some combination thereof. For example, in some embodiments, the transducer assembly 480 includes cartilage conduction transducers for each ear, and does not include any bone conduction transducers. In some embodiments, the transducer assembly may include one or more transducers to cover different parts of a frequency range. For example, a cartilage conduction transducer may be used to cover a first part of a frequency range and a bone conduction transducer may be used to cover a second part of a frequency range. In some embodiments, the first part of the frequency range is higher than the second part of the frequency range.

A bone conduction transducer generates acoustic pressure waves by vibrating tissue (bone is primary conduction pathway) in the user's head. A bone conduction transducer is configured to couple to a portion of the user's skull. The bone conduction transducer receives vibration instructions from the controller 140, and vibrates a portion of the user's skull based on the received instructions. The vibrations from the bone conduction transducer generate a tissue-borne acoustic pressure wave that propagates toward the user's cochlea, bypassing the eardrum. Furthermore, as previously noted with respect to FIGS. 1 and 2, while a bone conduction transducer primarily generates a tissue borne acoustic pressure wave, there may be a secondary effect whereby the generated tissue borne acoustic pressure waves vibrate the eardrum and/or portions of the ear canal which results in an airborne acoustic pressure wave that originates within the ear canal.

A cartilage conduction transducer generates acoustic pressure waves by vibrating one or more portions of the auricular cartilage of the ear in accordance with vibration instructions. The cartilage conduction transducer may be configured to be coupled to one or more portions of the auricular cartilage of the ear. A cartilage conduction transducer may be located anywhere along the auricular cartilage around the outer ear (e.g., the pinna, the tragus, some other portion of the auricular cartilage, or some combination thereof). As noted above with regard to FIG. 1, a cartilage conduction transducer may generate: airborne acoustic pressure waves outside the ear canal; tissue born acoustic pressure waves that cause some portions of the ear canal to vibrate thereby generating an airborne acoustic pressure wave within the ear canal; or some combination thereof.

The communication assembly 485 communicates with the one or more ear plug assemblies 410. The communication assembly 485 includes one or more receivers and may additionally include one or more transmitters. The communication assembly 485 is configured to receive signals and/or locator signals sent by the one or more ear plug assemblies 410. In some embodiments, the communication assembly 485 may also provide control instructions to the one or more ear plug assemblies 410 via the one or more transmitters.

The controller 490 generates vibration instructions in accordance with audio content to be provided for the user. Vibration instructions control how the transducer assembly 480 generates acoustic pressure waves. In some embodiments the vibration instructions are such that the transducer assembly 480 generates spatialized audio content. The controller 490 generates the vibration instructions based on audio data and one or more frequency response models (e.g., one for each ear). The frequency response model describes an acoustic pressure within each ear. The vibration may adjust the vibration instructions to achieve a target frequency response (e.g., as discussed in detail below with regard to FIG. 5). In some embodiments, the vibration instructions may also be based on, e.g., head-related transfer functions (HRTFs) of the user, array transfer functions (ATFs), etc. For example, the HRTFs may be used to make it appear that the audio content is appearing to originate from a physical object and/or a virtual object in a local area of the audio system 400. The vibration instructions may also be used to, e.g., generate an antiwave that mitigates certain sounds (e.g., cancel canal resonances and/or external noise), determine a proper fit of the ear-plug assembly within the ear, determine a proper fit of the transducer assembly on to head, correct for fit-fit and/or person to person variation, pair an acoustic conduction system with a new ear-plug assembly, give an one-time tuning information to the acoustic conduction system 420 to be used without the ear-plug assembly, determine a proper fit of the transducer assembly 480 on to head, correct for hearing loss and/or damage, or some combination thereof.

The controller 490 may generate and/or update the vibration instructions based on whether it receives a locator signal from the one or more of the ear plug assemblies 410. In cases where no locator signal is received, the controller 490 generates vibration instructions which cause the transducer assembly 480 to compensate for the loss of low frequency components due to the un-obstructed ear canal. In some embodiments, the controller 490 uses the locator signal to determine e.g., whether the ear-plug assembly 410 is worn by the user, an amount of seal (i.e., home much an ear-plug body occludes the ear canal), a quality of seal (i.e., how much sound is blocked by the ear-plug assembly 410), or some combination thereof.

In cases where a locator signal has been received (e.g., via the communication assembly 485) from an ear-plug assembly 410, the controller 490 may update the frequency response model (e.g., by applying a corrective filter) to reflect that the ear-plug assembly 410 is within the ear canal. The corrective filter is such that audio content provided by the transducer assembly 480 would have a frequency response that approximates a target frequency response for the ear. The corrective filter may be a static filter that was previously determined using data over some population of people. In this instance the corrective filter represents an average correction that can be applied. The controller 490 may then update the vibration instructions based in part on the updated frequency response model. For example, the updated vibration instructions compensate for the reduced loss of low frequency components in the audio content.

Moreover, in some cases, the controller 490 may update the vibration instructions based in part on the signals received from the ear-plug assembly 410. In some embodiments, the received signals may describe the airborne acoustic pressure waves within the ear canal (detected by the internal acoustic sensor assembly 440). The controller 490 may use the received signals to determine sound pressure within the ear canal. And based on the detected sound pressure, the controller 490 may dynamically determine and apply a corrective filter to a frequency response model such that audio content provided by the transducer assembly 480 is within a threshold value of a target frequency response for some frequency range (e.g., all audible frequencies). In some embodiments, the target frequency response is flat (e.g., magnitude does not change with frequency). In other embodiments, the target frequency response may have some other shape based on the user. For example, it may be adjusted to account of for how a particular user hears, offset for hearing loss, offset the occlusion effect, etc.

For example, the internal acoustic sensor assembly 440 may be used to improve the audio playback and mitigate the occlusion effect. An ear-plug placed inside the ear-canal can cause the occlusion effect. The occlusion effect is amplification of the user's own voice due to the reflection of the vibration back toward the eardrum. In the case of the open canal, the transmission of a patient's own voice is not perceived negatively because the sound is leaked into the environment outside the ear. However, when the ear canal is occluded (e.g., via the ear-plug assembly 410) some of the sound may be unable to escape and may be trapped. The occluded ear canal becomes a resonant cavity, and the low frequencies, which have been boosted, pass into the cochlea because the impedance at the tympanic membrane has become favorable to the passage of the low-frequency portion of the spectrum. The controller 490 may use the use the sound pressure within the ear canal to generate the corrective filter in a manner that would mitigate (and potentially offset) the occlusion effect.

In some embodiments, the received signals may describe the airborne acoustic pressure waves detected by the external acoustic sensor assembly 450. The controller 490 may determine that the detected airborne acoustic waves are from a local area surrounding the audio system 400. For example, they be from a person speaking to the user, a television, etc. The controller 490 may provide a hear-thru functionality, in which it generates vibration instructions corresponding to the detected airborne acoustic waves, and provides the vibration instructions to the transducer assembly 480. In this manner, a user of the audio system 400 may have one or both of their ears occluded with an ear-plug assembly 410, but still receive sound from the local area.

In some embodiments, the controller 490 may determine that the detected airborne acoustic waves are generated by cartilage conduction transducers. In these instances, the controller 490 may compare the detected airborne acoustic waves to a target waveform associated with the audio content, and update the vibration instructions to minimize a difference between the detected airborne acoustic waves and the target waveform.

Figure 5:
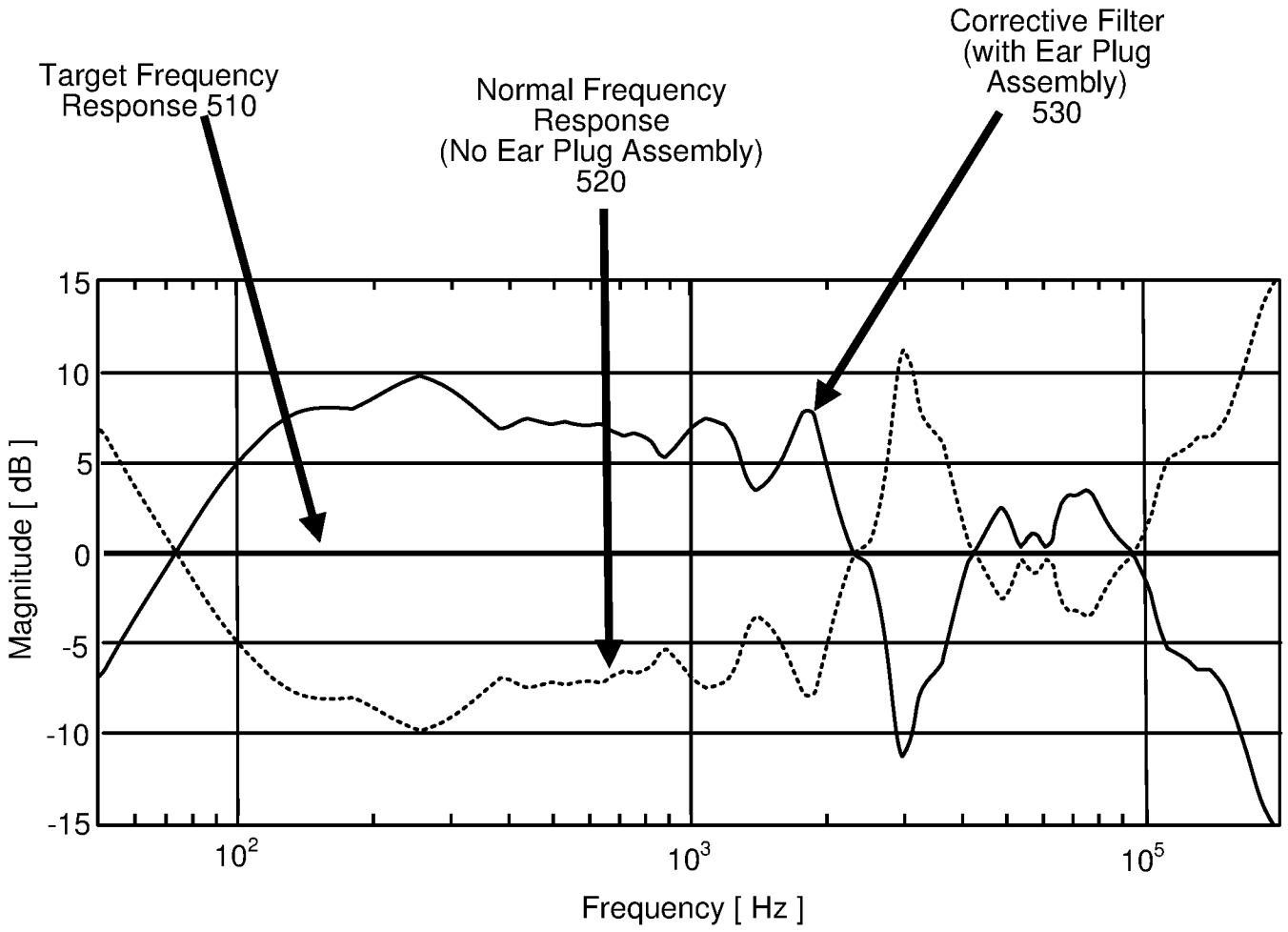
FIG. 5 is a graph depicting adjustment of a detected frequency response of audio signals produced by an audio system, in accordance with one or embodiments.

FIG. 5 is a graph 500 depicting filtered sound pressure adjustment using the audio system of FIG. 4, in accordance with one or more embodiments. The graph 500 is an example of the audio system 400 tuning sound pressure within the ear canal based on an ear-plug assembly located within the ear canal. The graph 500 depicts plots of: a target frequency response 510, a normal frequency response 520, and a corrective filter 530. The target frequency response 510 depicts a target pressure as a function of frequency. In FIG. 5, the target frequency response 510 depicted is a flat line, i.e., a curve depicting no change in magnitude across the depicted range of frequencies. Accordingly, no particular frequency is attenuated or amplified relative to other frequencies. Note that in other embodiments, the target frequency response 510 may have some other shape (e.g., to compensate for hearing loss at various frequencies).

The normal frequency response 520 depicts acoustic pressure as a function of frequency as measured in a person who is not wearing the ear-plug assembly 410 (i.e., their ear canal is open). This may be measured by, e.g., placing a small microphone within the ear canal and detecting airborne acoustic pressure waves within the ear canal while content is being presented via the acoustic conduction system 420. This data can be measured for a large population of users which can then be averaged such that it would potentially apply to a large group of people.

The corrective filter 530 is a filter used by the acoustic conduction system 420 when the ear-plug assembly 410 is being worn by the user (i.e., in the ear canal). The corrective filter 530 offsets the normal frequency response 520, thereby providing an approximation of the target frequency response 510. In some embodiments, a corrective filter is based on the average of multiple normal frequency responses.

Figure 6:
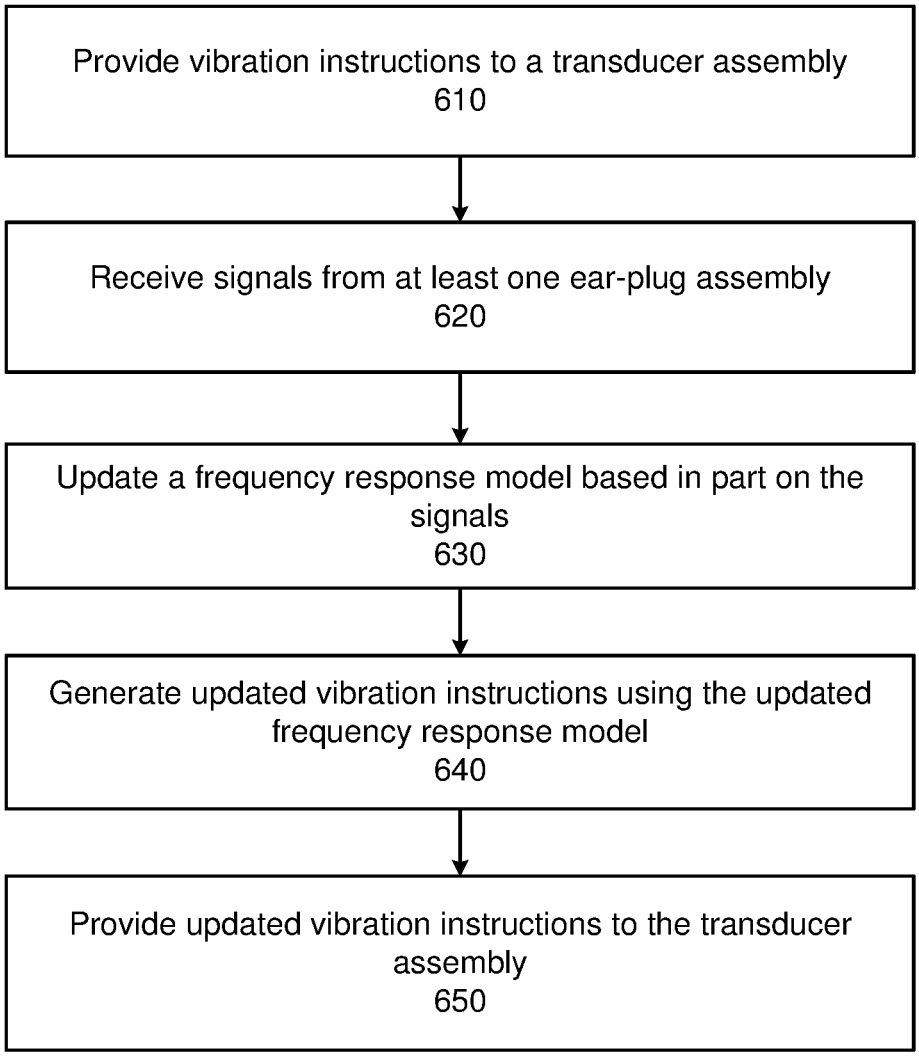
FIG. 6 is a flowchart illustrating a process for providing audio content using an audio system and an ear-plug assembly, in accordance with one or more embodiments.

FIG. 6 is a flowchart illustrating a process of operating an audio system, in accordance with an embodiment. The process 600 of FIG. 6 may be performed by an audio system (e.g., the audio system 400 in FIG. 4). Other entities (e.g., a headset and/or console) may perform some or all of the steps of the process in other embodiments. Likewise, embodiments may include different and/or additional steps, or perform the steps in different orders.

The audio system 400 provides 610 vibration instructions to the transducer assembly. The audio system 500 generates and/or updates vibration instructions based on audio data. The vibration instructions cause one or more transducers to provide audio content to the user via acoustic pressure waves, and produces at least some airborne acoustic pressure waves within one or both ear canals of a user.

The audio system 500 receives 620 signals from at least one ear-plug assembly (e.g., the ear-plug assembly 410). The at least one ear-plug assembly is worn by the user, and at least partially occludes the ear canal of the user. The received signals may include, e.g., signals corresponding to airborne acoustic waves detected by the internal acoustic sensor assembly 440, signals corresponding to airborne acoustic waves detected by the external acoustic sensor assembly 340, locator signals from the locator assembly 430, signals from the power assembly 460, or some combination thereof.

The audio system 500 updates 630 a frequency response model based in part on the signals. In some embodiments, the ear plug assembly is inactive, and the signals indicate that the user is wearing the ear-plug assemblies. The audio system 500 then updates a corrective filter to account for the mitigation of loss of low frequency content caused by wearing the ear-plug assemblies. The audio system 500 then applies the updated corrective filter to a frequency response model describing the ear. In other embodiments, the signals may include signals from an internal acoustic sensor assembly describing the airborne acoustic pressure waves within the ear canal. The audio system 500 may dynamically adjust the corrective filter and apply it to the frequency response model such that a frequency response of the audio content provided by the transducer assembly is within a threshold value of a target frequency response for some frequency range.

The audio system generates 640 updated vibration instructions using the updated frequency response model. The vibration instructions are also based on the audio data.

The audio system 500 provides 650 the updated vibration instructions to the transducer assembly. The transducer assembly provides updated audio content to the user using the updated vibration instructions.

System Environment

Figure 7:
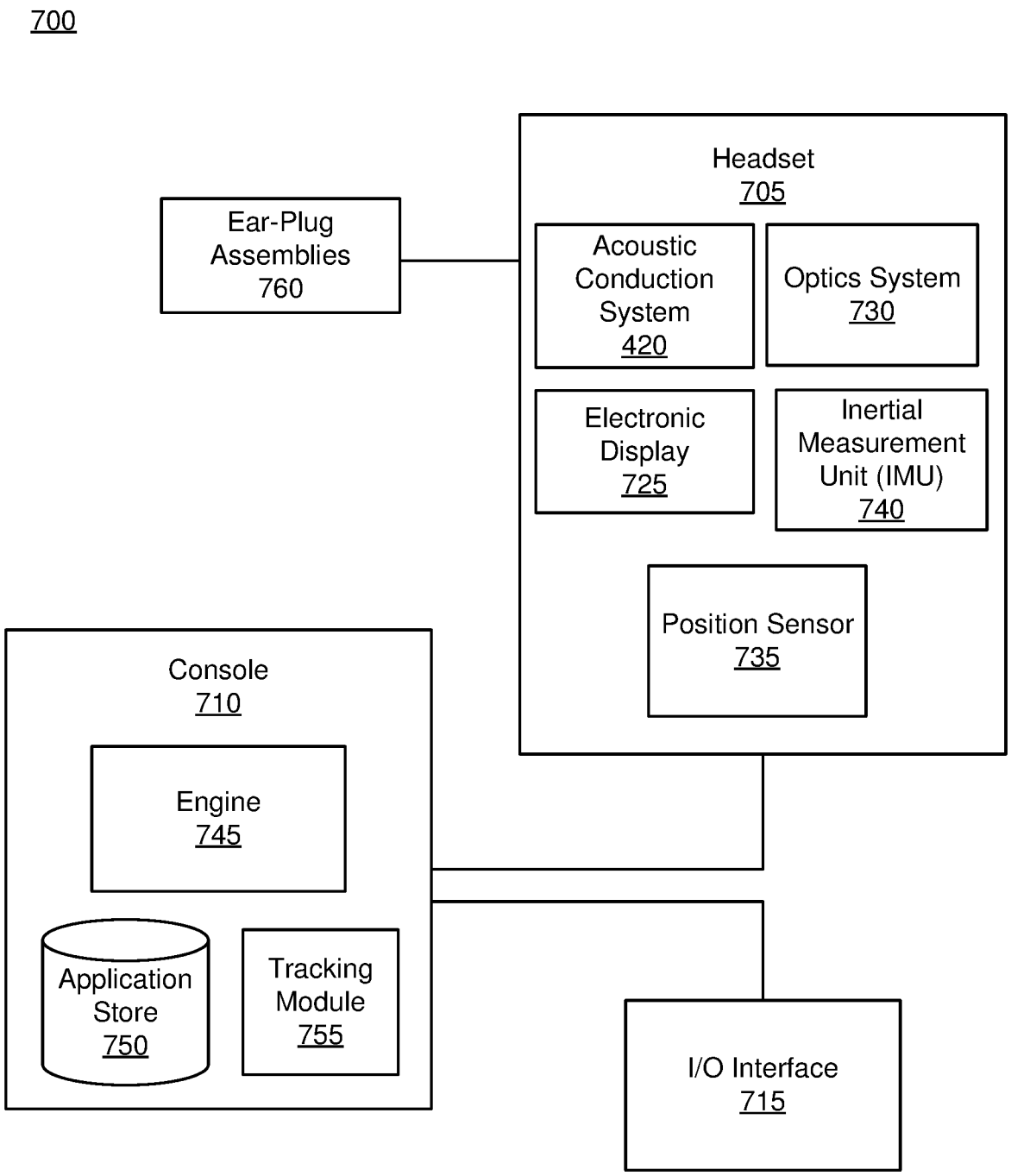
FIG. 7 is a block diagram of a system environment that includes a headset with an audio system, a console, and an ear plug, in accordance with one or more embodiments.

FIG. 7 is a system environment 700 of the headset including a bone conduction system and/or a cartilage conduction audio system, in accordance with an embodiment. The system 700 may operate in an artificial reality environment, e.g., a virtual reality, an augmented reality, a mixed reality environment, or some combination thereof. The system 700 shown by FIG. 7 comprises a headset 705, an input/output (I/O) interface 715 that is coupled to a console 710, and the ear plug assemblies 760 that are communicatively coupled to the acoustic conduction system 420. The headset 705 may be an embodiment of the headset 100. While FIG. 7 shows an example system 700 including one headset 705 and one I/O interface 715, in other embodiments any number of these components may be included in the system 700. For example, there may be multiple headsets 705 each having an associated I/O interface 715 with each headset 705 and I/O interface 715 communicating with the console 710. In alternative configurations, different and/or additional components may be included in the system 700. Additionally, functionality described in conjunction with one or more of the components shown in FIG. 7 may be distributed among the components in a different manner than described in conjunction with FIG. 7 in some embodiments. For example, some or all of the functionality of the console 710 is provided by the headset 705.

The headset 705 may be an NED or HMD that presents content to a user comprising augmented views of a physical, real-world environment with computer-generated elements (e.g., two dimensional (2D) or three dimensional (3D) images, 2D or 3D video, sound, etc.). In some embodiments, the presented content includes audio that is presented via an audio block 720 that receives audio information from the headset 705, the console 710, or both, and presents audio data based on the audio information. In some embodiments, the headset 705 presents virtual content to the user that is based in part on a real environment surrounding the user. For example, virtual content may be presented to a user of the eyewear device. The user physically may be in a room, and virtual walls and a virtual floor of the room are rendered as part of the virtual content.

The headset 705 includes the acoustic conduction system 420. As described above with regard to FIG. 4, the acoustic conduction system 410 provides audio content (e.g., via a transducer assembly) to the user. The acoustic conduction system 410 directly vibrates tissue (e.g., bone, skin, cartilage, etc.) to provide audio content via acoustic pressure waves.

The headset 705 may include an electronic display 725, an optics block 730, one or more position sensors 735, and an inertial measurement Unit (IMU) 740. The electronic display 725 and the optics block 730 is one embodiment of the lens 110 as shown in FIG. 1. The position sensors 735 and the IMU 740 is one embodiment of sensor device 115 as shown in FIG. 1. Some embodiments of the headset 705 have different components than those described in conjunction with FIG. 7. Additionally, the functionality provided by various components described in conjunction with FIG. 7 may be differently distributed among the components of the headset 705 in other embodiments, or be captured in separate assemblies remote from the headset 705.

The electronic display 725 displays 2D or 3D images to the user in accordance with data received from the console 710. In various embodiments, the electronic display 725 comprises a single electronic display or multiple electronic displays (e.g., a display for each eye of a user). Examples of the electronic display 725 include: a liquid crystal display (LCD), an organic light emitting diode (OLED) display, an active-matrix organic light-emitting diode display (AMOLED), some other display, or some combination thereof.

The optics block 730 magnifies image light received from the electronic display 725, corrects optical errors associated with the image light, and presents the corrected image light to a user of the headset 705. In various embodiments, the optics block 730 includes one or more optical elements. Example optical elements included in the optics block 730 include: an aperture, a Fresnel lens, a convex lens, a concave lens, a filter, a reflecting surface, or any other suitable optical element that affects image light. Moreover, the optics block 730 may include combinations of different optical elements. In some embodiments, one or more of the optical elements in the optics block 730 may have one or more coatings, such as partially reflective or anti-reflective coatings, Magnification and focusing of the image light by the optics block 730 allows the electronic display 725 to be physically smaller, weigh less, and consume less power than larger displays. Additionally, magnification may increase the field of view of the content presented by the electronic display 725. For example, the field of view of the displayed content is such that the displayed content is presented using almost all (e.g., approximately 110 degrees diagonal), and in some cases all, of the user's field of view. Additionally, in some embodiments, the amount of magnification may be adjusted by adding or removing optical elements.

The IMU 740 is an electronic device that generates data indicating a position of the headset 705 based on measurement signals received from one or more of the position sensors 735. A position sensor 735 generates one or more measurement signals in response to motion of the headset 705. Examples of position sensors 735 include: one or more accelerometers, one or more gyroscopes, one or more magnetometers, another suitable type of sensor that detects motion, a type of sensor used for error correction of the IMU 740, or some combination thereof. The position sensors 735 may be located external to the IMU 740, internal to the IMU 740, or some combination thereof.

Based on the one or more measurement signals from one or more position sensors 735, the IMU 740 generates data indicating an estimated current position of the headset 705 relative to an initial position of the headset 705. For example, the position sensors 735 include multiple accelerometers to measure translational motion (forward/back, up/down, left/right) and multiple gyroscopes to measure rotational motion (e.g., pitch, yaw, and roll). In some embodiments, the IMU 740 rapidly samples the measurement signals and calculates the estimated current position of the headset 705 from the sampled data. For example, the IMU 740 integrates the measurement signals received from the accelerometers over time to estimate a velocity vector and integrates the velocity vector over time to determine an estimated current position of a reference point on the headset 705. Alternatively, the IMU 740 provides the sampled measurement signals to the console 710, which interprets the data to reduce error. The reference point is a point that may be used to describe the position of the headset 705. The reference point may generally be defined as a point in space or a position related to the eyewear device's 705 orientation and position.

The IMU 740 receives one or more parameters from the console 710. As further discussed below, the one or more parameters are used to maintain tracking of the headset 705. Based on a received parameter, the IMU 740 may adjust one or more IMU parameters (e.g., sample rate). In some embodiments, certain parameters cause the IMU 740 to update an initial position of the reference point so it corresponds to a next position of the reference point. Updating the initial position of the reference point as the next calibrated position of the reference point helps reduce accumulated error associated with the current position estimated the IMU 740. The accumulated error, also referred to as drift error, causes the estimated position of the reference point to "drift" away from the actual position of the reference point over time. In some embodiments of the headset 705, the IMU 740 may be a dedicated hardware component. In other embodiments, the IMU 740 may be a software component implemented in one or more processors.

The I/O interface 715 is a device that allows a user to send action requests and receive responses from the console 710. An action request is a request to perform a particular action. For example, an action request may be an instruction to start or end capture of image or video data, or an instruction to perform a particular action within an application. The I/O interface 715 may include one or more input devices. Example input devices include: a keyboard, a mouse, a game controller, or any other suitable device for receiving action requests and communicating the action requests to the console 710. An action request received by the I/O interface 715 is communicated to the console 710, which performs an action corresponding to the action request. In some embodiments, the I/O interface 715 includes an IMU 740, as further described above, that captures calibration data indicating an estimated position of the I/O interface 715 relative to an initial position of the I/O interface 715. In some embodiments, the I/O interface 715 may provide haptic feedback to the user in accordance with instructions received from the console 710. For example, haptic feedback is provided when an action request is received, or the console 710 communicates instructions to the I/O interface 715 causing the I/O interface 715 to generate haptic feedback when the console 710 performs an action.

The console 710 provides content to the headset 705 for processing in accordance with information received from one or more of: the headset 705 and the I/O interface 715. In the example shown in FIG. 7, the console 710 includes an application store 750, a tracking module 755 and an engine 745. Some embodiments of the console 710 have different modules or components than those described in conjunction with FIG. 7. Similarly, the functions further described below may be distributed among components of the console 710 in a different manner than described in conjunction with FIG. 7.

The application store 750 stores one or more applications for execution by the console 710. An application is a group of instructions, that when executed by a processor, generates content for presentation to the user. Content generated by an application may be in response to inputs received from the user via movement of the headset 705 or the I/O interface 715. Examples of applications include: gaming applications, conferencing applications, video playback applications, or other suitable applications.

The tracking module 755 calibrates the system environment 700 using one or more calibration parameters and may adjust one or more calibration parameters to reduce error in determination of the position of the headset 705 or of the I/O interface 715. Calibration performed by the tracking module 755 also accounts for information received from the IMU 740 in the headset 705 and/or an IMU 740 included in the I/O interface 715. Additionally, if tracking of the headset 705 is lost, the tracking module 755 may re-calibrate some or all of the system environment 700.

The tracking module 755 tracks movements of the headset 705 or of the I/O interface 715 using information from the one or more position sensors 735, the IMU 740 or some combination thereof. For example, the tracking module 755 determines a position of a reference point of the headset 705 in a mapping of a local area based on information from the headset 705. The tracking module 755 may also determine positions of the reference point of the headset 705 or a reference point of the I/O interface 715 using data indicating a position of the headset 705 from the IMU 740 or using data indicating a position of the I/O interface 715 from an IMU 740 included in the I/O interface 715, respectively. Additionally, in some embodiments, the tracking module 755 may use portions of data indicating a position or the headset 705 from the IMU 740 to predict a future location of the headset 705. The tracking module 755 provides the estimated or predicted future position of the headset 705 or the I/O interface 715 to the engine 745.

The engine 745 also executes applications within the system environment 700 and receives position information, acceleration information, velocity information, predicted future positions, or some combination thereof, of the headset 705 from the tracking module 755. Based on the received information, the engine 745 determines content to provide to the headset 705 for presentation to the user. For example, if the received information indicates that the user has looked to the left, the engine 745 generates content for the headset 705 that mirrors the user's movement in a virtual environment or in an environment augmenting the local area with additional content. Additionally, the engine 745 performs an action within an application executing on the console 710 in response to an action request received from the I/O interface 715 and provides feedback to the user that the action was performed. The provided feedback may be visual or audible feedback via the headset 705 or haptic feedback via the I/O interface 715.

The ear plug assemblies 760 mitigate loss of low frequency components of the audio content. The ear plug assemblies 760 include an ear-plug assembly 410 for each ear. The ear plug assemblies 760 mitigating leakage of the low frequency component of airborne acoustic pressure waves generated in the ear canal by the acoustic conduction system 420. In some embodiments, the ear plug assemblies 760 provide data regarding the airborne acoustic pressure waves generated in the ear canal and/or from the local area to the acoustic conduction system 420.

Additional Configuration Information

The foregoing description of the embodiments of the disclosure has been presented for the purpose of illustration; it is not intended to be exhaustive or to limit the disclosure to the precise forms disclosed. Persons skilled in the relevant art can appreciate that many modifications and variations are possible in light of the above disclosure.

Some portions of this description describe the embodiments of the disclosure in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all of the steps, operations, or processes described.

Embodiments of the disclosure may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments of the disclosure may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the inventive subject matter. It is therefore intended that the scope of the disclosure be limited not by this detailed description, but rather by any claims that issue on an application based hereon. Accordingly, the disclosure of the embodiments is intended to be illustrative, but not limiting, of the scope of the disclosure, which is set forth in the following claims.

What is claimed is:

1. An ear-plug assembly comprising:

a plug body configured to at least partially fit inside an ear canal of a user, wherein the plug body mitigates loss of a portion of an airborne acoustic pressure wave within the ear canal; and a locator assembly within the plug body that provides a signal to an acoustic conduction system identifying that the ear-plug assembly is at least partially inside the ear canal, wherein responsive to receiving the signal, the acoustic conduction system is configured to generate a tissue born acoustic pressure wave that causes an updated airborne acoustic pressure wave inside the ear canal.

2. The ear-plug assembly of claim 1, wherein the acoustic conduction system comprises at least one of:

a bone conduction transducer; and a cartilage conduction transducer.

3. The ear-plug assembly of claim 1, wherein the locator assembly includes a sensor comprising a radio frequency identification (RFID) tag.

4. The ear-plug assembly of claim 1, further comprising:

an internal acoustic sensor assembly configured to detect airborne acoustic pressure waves between the ear drum and the ear-plug assembly.

5. The ear-plug assembly of claim 4, further comprising:

a data transfer assembly configured to transmit signals to the acoustic conduction system, the signals corresponding to the detected airborne acoustic pressure waves.

6. The ear-plug assembly of claim 4, wherein the signal provided by the locator assembly is based in part on the airborne acoustic pressure waves detected by the internal acoustic sensor.

7. The ear-plug assembly of claim 1, further comprising:

an external acoustic sensor assembly configured to detect airborne acoustic pressure waves from a local area outside of the ear canal.

8. The ear-plug assembly of claim 7, further comprising:

a data transfer assembly configured to transmit signals to the acoustic conduction system, the signals corresponding to the detected airborne acoustic pressure waves, wherein the acoustic conduction system retransmits the detected airborne acoustic pressure waves as audio content to the user using a transducer assembly that generates tissue borne acoustic pressure waves.

9. The ear-plug assembly of claim 1, wherein the plug body fully occludes the ear canal of the user.

10. The ear-plug assembly of claim 1, wherein the plug body mitigates leakage of airborne acoustic pressure waves that are less than 2000 Hz from the ear canal.

11. The ear-plug assembly of claim 1, wherein the plug body occludes some but not all of a portion of the ear canal.

12. An audio system, comprising:

an ear-plug assembly, comprising:

a plug body configured to at least partially fit inside an ear canal of a user, wherein the plug body mitigates loss of a portion of an airborne acoustic pressure wave within the ear canal; and a locator assembly within the plug body that emits a signal that identifies that the ear-plug assembly is at least partially inside the ear canal;

an acoustic conduction system, comprising:

a transducer assembly configured to be coupled to a portion of the user's head, the transducer assembly further configured generate acoustic pressure waves in accordance with vibration instructions; and a controller, configured to:

provide vibration instructions to the transducer assembly, update a frequency response model based on the received signal, generate updated vibration instructions using the updated frequency response model, and provide updated vibration instructions to the transducer assembly, wherein the acoustic conduction system is configured to generate a tissue born acoustic pressure wave that causes an updated airborne acoustic pressure wave inside the ear canal.

13. The audio system of claim 12, wherein the transducer assembly comprises at least one of:

a bone conduction transducer; and a cartilage conduction transducer.

14. The audio system of claim 12, wherein the ear-plug assembly further comprises:

an internal acoustic sensor assembly configured to detect airborne acoustic pressure waves between the ear drum and the ear-plug assembly; and a data transfer assembly configured to transmit signals to the acoustic conduction system, the signals corresponding to the detected airborne acoustic pressure waves.

15. The audio system of claim 12, wherein the ear-plug assembly further comprises:

an external acoustic sensor assembly configured to detect airborne acoustic pressure waves from a local area outside of the ear canal; and a data transfer assembly configured to transmit signals to the acoustic conduction system, the signals corresponding to the detected airborne acoustic pressure waves.

16. The audio system of claim 15, wherein the acoustic conduction system retransmits the detected airborne acoustic pressure waves as audio content to the user using the transducer assembly.

17. A method comprising:

provide vibration instructions to a transducer assembly, wherein the transducer assembly provides audio content to a user by vibrating tissue of the user in accordance with the vibration instructions;

receiving signals from a sensor coupled to an ear-plug assembly located at least partially inside an ear canal of the user;

updating a frequency response model based on the received signals;

generating updated vibration instructions using the updated frequency response model; and providing, the updated vibration instructions to the transducer assembly, wherein the transducer assembly provides the audio content such that a frequency response of the ear approximates a target frequency response.

18. The method of claim 17, wherein the signals indicate that the ear-plug assembly is within the ear canal, and updating the frequency response model based on the received signals comprises:

applying a corrective filter to the frequency response model.

19. The method of claim 17, wherein the signals describe airborne acoustic waves within the ear canal, the method further comprising:

dynamically updating the frequency response model based on the received signals.

20. The method of claim 17, wherein the signals describe detected airborne acoustic pressure waves in a local area outside of the ear canal, the method further comprising:

retransmitting the detected airborne acoustic pressure waves as audio content using the transducer assembly.

* * * * *